US009711077B1

(12) United States Patent
Lim et al.

(10) Patent No.: US 9,711,077 B1
(45) Date of Patent: Jul. 18, 2017

(54) ORGANIC LIGHT EMITTING DIODE DISPLAY PANEL

(71) Applicant: LG Display Co., Ltd., Seoul (KR)

(72) Inventors: Hyun Soo Lim, Goyang-si (KR); Juhn Suk Yoo, Seoul (KR); Jung Min Lee, Paju (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/464,074

(22) Filed: Mar. 20, 2017

Related U.S. Application Data

(63) Continuation of application No. 14/829,499, filed on Aug. 18, 2015, now Pat. No. 9,633,593.

(30) Foreign Application Priority Data

Sep. 30, 2014 (KR) ..... 10-2014-0130687

(51) Int. Cl.

| | |
|---|---|
| ***G09G 3/20*** | (2006.01) |
| ***G09G 3/3233*** | (2016.01) |
| ***G09G 3/3266*** | (2016.01) |
| ***G09G 3/3275*** | (2016.01) |

(52) U.S. Cl.
CPC ..... *G09G 3/2003* (2013.01); *G09G 3/2074* (2013.01); *G09G 3/3233* (2013.01); *G09G 3/3266* (2013.01); *G09G 3/3275* (2013.01); *G09G 2300/0452* (2013.01); *G09G 2300/0465* (2013.01); *G09G 2310/08* (2013.01); *G09G 2320/0233* (2013.01); *G09G 2320/0242* (2013.01); *G09G 2330/02* (2013.01)

(58) Field of Classification Search
CPC .. G09G 3/2003; G09G 3/2074; G09G 3/3233; G09G 2300/0426; G09G 2320/0209; G09G 2300/0452
See application file for complete search history.

(56) References Cited

U.S. PATENT DOCUMENTS

| | | | | |
|---|---|---|---|---|
| 2011/0043500 | A1* | 2/2011 | Kwak | G09G 3/006 345/206 |
| 2014/0292622 | A1 | 10/2014 | Lee | |
| 2014/0306198 | A1 | 10/2014 | Im et al. | |

* cited by examiner

*Primary Examiner* — Abbas Abdulselam
(74) *Attorney, Agent, or Firm* — Fenwick & West LLP

(57) ABSTRACT

An organic light emitting diode display panel is disclosed which is defined into a plurality of pixel regions and includes: first through third pixel drivers arranged in each of the pixel regions and configured to each drive respective organic light emitting diode; and first through third pixel electrodes arranged in each of the pixel regions and connected to the first through third pixel drivers. The first and second pixel drivers within an odd-numbered pixel region share a first power supply line with each other. The third pixel driver within the odd-numbered pixel region shares a second power supply line with the first pixel driver within an even-numbered pixel region adjacent to the odd-numbered pixel region. The second and third pixel electrodes are arranged along a first direction parallel to a major axis of the first pixel electrode and disposed to expend along second directions perpendicular to the first direction.

12 Claims, 10 Drawing Sheets

ORGANIC LIGHT EMITTING DIODE DISPLAY PANEL

The present application is a continuation application of U.S. patent application Ser. No. 14/829,499, filed on Aug. 18, 2015, which claims priority under 35 U.S.C. §119(a) of Korean Patent Application No. 10-2014-0130687 filed on Sep. 30, 2014, all of which are incorporated by reference in their entirety for all purposes.

BACKGROUND

Field of the Disclosure

The present application relates to an organic light emitting diode display panel.

Description of the Related Art

Recently, a variety of panel display devices with reduced weight and volume corresponding to disadvantages of cathode ray tube (CRT) are being developed. The panel display devices include liquid crystal display (LCD) devices, field emission display (FED) devices, plasma display panels (PDPs), electroluminescence devices (such as OLEDs), etc.

The PDPs have advantages such as simple structure, simple manufacture procedure, lightness and thinness, and are easy to provide a large-sized screen. In view of these points, the PDPs attract public attention. However, the PDPs have problems such as low light emission efficiency, low brightness and high power consumption. Also, thin film transistor LCD devices use thin film transistors as switching elements. Thin film transistor LCD devices are being widely used as the flat display devices. However, the thin film transistor LCD devices have disadvantages such as a narrow viewing angle and a slow response time, because of being non-luminous devices. Meanwhile, the electroluminescence display devices are classified as either an inorganic light emitting diode display device or an organic light emitting diode (OLED) display device depending on the formation material of a light emission layer. The OLED display device corresponding to a self-illuminating display device has features such as fast response times, high light emission efficiency, high brightness and wide viewing angle.

The OLED display device controls a voltage between a gate electrode and a source electrode of a driving transistor. As such, a current flowing from a drain electrode of the driving transistor toward the source electrode can be controlled. The current passing through the drain and source electrodes is applied to an OLED and allows the OLED to emit light. The light emission quantity of the OLED can be controlled by adjusting the current flowing into the OLED.

Demand for high definition display devices has recently increased. As the number of pixels formed in the display panel increases, an aperture ratio must be lowered. Moreover, data interference between signal lines undesirably increases as the spatial gap between signal lines becomes narrower. Due to this, the color gamut of the high definition display devices undesirably deteriorates.

BRIEF SUMMARY

Accordingly, embodiments of the present application are directed to an organic light emitting diode (OLED) display panel that substantially obviates one or more of problems due to the limitations and disadvantages of the related art.

The embodiments relate to providing an OLED display panel adapted to enlarge an aperture ratio.

Also, the embodiments relate to providing an OLED display panel adapted to enhance a color gamut by minimizing interference between signal lines.

Moreover, the embodiments relate to providing an OLED display panel adapted to increase the density of pixels by including a power supply line sharing structure.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

An organic light emitting diode (OLED) display panel according to an aspect of the present embodiment is defined into a plurality of pixel regions and includes: first through third pixel drivers arranged in each pixel region and configured to each drive a respective OLED; and first through third pixel electrodes arranged in each pixel region and connected to the first through third pixel drivers. The first and second pixel drivers within an odd-numbered pixel region share a first power supply line which crosses the odd-numbered pixel region. The third pixel driver within the odd-numbered pixel region shares a second power supply line with the first pixel driver within an even-numbered pixel region adjacent to the odd-numbered pixel region. The second power supply line is disposed in a boundary region between the odd-numbered pixel region and the even-numbered pixel region. The second and third pixel electrodes are arranged along a first direction parallel to a major axis of the first pixel electrode and disposed to expend along a second direction perpendicular to the first direction.

The OLED display panel according to an aspect of the present embodiment allows the first through third pixel drivers within the odd-numbered pixel region to be connected to first through third data lines. The second and third data lines are disposed in such a manner as to overlap with the second and third pixel electrodes within the odd-numbered pixel region.

The OLED display panel according to an aspect of the present embodiment enables the second and third pixel drivers within the even-numbered pixel region to share a third power supply line which crosses the even-numbered pixel region.

The OLED display panel according to an aspect of the present embodiment allows the third power supply line to be disposed in such a manner as to overlap with the second and third pixel electrodes within the even-numbered pixel region.

In the OLED display panel according to an aspect of the present embodiment, the first pixel electrode is included in a blue sub-pixel, the second pixel electrode is included in a green sub-pixel, and the third pixel electrode is included in a red sub-pixel.

An OLED display device according to another aspect of the present embodiment is defined into a plurality of pixel regions and includes: first through third pixel drivers arranged in each pixel region and configured to drive a respective OLED; and first through third pixel electrodes arranged in each pixel region and connected to the first through third pixel drivers. The first pixel driver within an even-numbered pixel region shares a first power supply line with the third pixel driver within a first odd-numbered pixel region adjacent to the even-numbered pixel region. The third pixel driver within the even-numbered pixel region shares a third power supply line with the first pixel driver within a second odd-numbered pixel region adjacent to the even-numbered pixel region. The second pixel driver within the even-numbered pixel region is connected to a second power supply line.

The OLED display panel according to another aspect of the present embodiment allows the third power supply line to be disposed in a boundary between the even-numbered pixel region and the second odd-numbered pixel region.

In the OLED display panel according to another aspect of the present embodiment, the third pixel driver within the even-numbered pixel region is connected to a first data line which is disposed in the boundary between the even-numbered pixel region and the second odd-numbered pixel region. Further, the first pixel driver within the second odd-numbered pixel region is connected to a second data line which is disposed in the boundary between the even-numbered pixel region and the second odd-numbered pixel region. The third power supply line is disposed between the first and second data lines.

The OLED display panel according to another aspect of the present embodiment enables the second and third pixel electrodes to not only be arranged along a first direction parallel to a major axis of the first pixel electrode but also disposed to expend along a second direction perpendicular to the first direction.

In the OLED display panel according to another aspect of the present embodiment, the first pixel driver within the even-numbered pixel region is connected to a first data line which is disposed in a boundary between the first odd-numbered pixel region and the even-numbered pixel region. Further, the second pixel driver within the even-numbered pixel region is connected to a second data line which is disposed in the even-numbered pixel region. The third pixel driver within the even-numbered pixel region is connected to a third data line which is disposed in a boundary between the even-numbered pixel region and the second odd-numbered pixel region. Further, the first pixel driver within the second odd-numbered pixel region is connected to a fourth data line which is disposed in the boundary between the even-numbered pixel region and the second odd-numbered pixel region. The first pixel electrode is disposed in a region between the first data line and the second power supply line without overlapping with the first data line and the second power supply line. Further, the second and third pixel electrodes are disposed between the second data line and the third data line without overlapping with the second data line and the third data line.

The OLED display panel according to another aspect of the present embodiment allows the second pixel driver within the even-numbered pixel region to be connected to a data line and a second power supply line which are disposed between the first and second pixel electrodes.

In the OLED display panel according to another aspect of the present embodiment, the first pixel electrode is included in a blue sub-pixel, the second pixel electrode is included in a green sub-pixel, and the third pixel electrode is included in a red sub-pixel.

The OLED display panel according to another aspect of the present embodiment allows each of the first through third pixel drivers to include: a scan switch configured to transfer a data signal to a first node in response to a scan pulse, a storage capacitor disposed between the first node and an anode electrode of the OLED, and a driving switch configured to control a current flowing through the OLED using a voltage stored in the storage capacitor.

The OLED display panel according to another aspect of the present embodiment enables the first through third pixel electrode to be used as anode electrodes of the respective OLEDs.

An OLED display panel according to still another aspect of the present embodiment is defined into a plurality of pixel regions and includes: a first sub-pixel, a second sub-pixel and a third sub-pixel, the first to third sub-pixels configured to display different colors and arranged within each of two pixel regions in such a manner that a major axis of the first sub-pixel crosses directions extending from axes of the second and third sub-pixels. The OLED display panel further includes three power supply lines and six data lines arranged to cross an arrangement direction of the two pixel regions, to each penetrate through one of the two pixel regions and to be parallel to one another. One of the three power supply lines transfers a power to two of the first through third sub-pixels and one of the six data lines transfers a data voltage to one of the first through third sub-pixels. The three power supply lines and the six data lines are repeatedly arranged along the arrangement direction of the two pixel regions in a sequence of one data line, one power supply line and another data line.

The OLED display panel according to still another aspect of the present embodiment allows the three power supply lines and the six data lines to be arranged in a sequence of one data line, one power supply line, another two data lines, another power supply line, still another two data lines, the other one power supply line and the other one data line.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

Figure

DETAILED DESCRIPTION OF THE EMBODIMENTS

Figure 1:
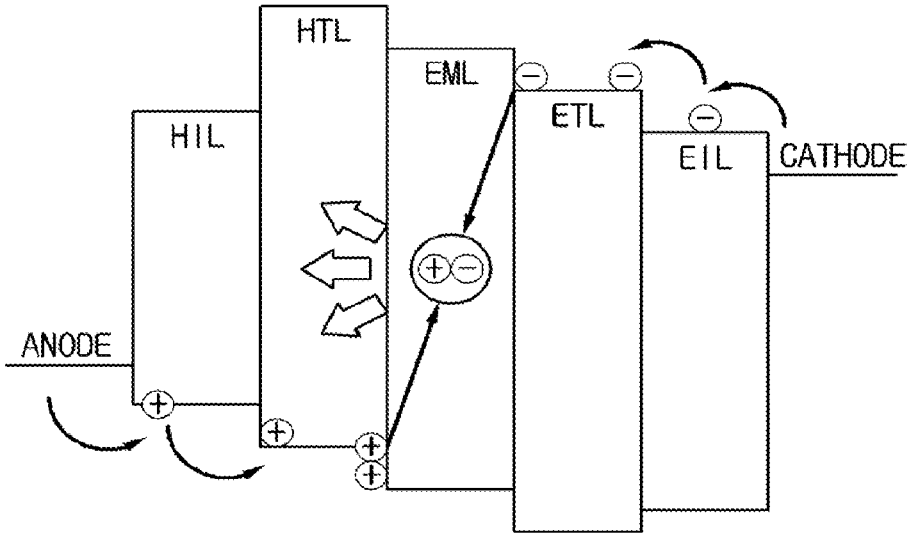
(FIG. 1 is a schematic diagram showing the structure of an organic light emitting diode (OLED).

Reference will now be made in detail to an organic light emitting diode (OLED) display device in accordance with the embodiments of the present disclosure, examples of which are illustrated in the accompanying drawings. These embodiments introduced hereinafter are provided as examples in order to convey their spirits to an ordinary skilled person in the art. Therefore, these embodiments might be embodied in a different manner, and thus are not limited to these embodiments described herein. In the drawings, the size, thickness and so on of a device can be exaggerated for convenience of explanation. Wherever possible, the same reference numbers will be used throughout this disclosure including the drawings to refer to the same or like parts.

A pixel structure enabling at least two sub-pixels to share a single high potential voltage line can be applied to an OLED display device as an efficient pixel design method for realizing high definition. In this case, not only the size (or area) of the sub-pixel must be reduced but also a distances between the sub-pixels must be decreased. As such, a distance between data lines, which are used to transfer data signal to the sub-pixels, must also be decreased.

A variety of pixel structures can now be applied to the OLED display device in order to realize high definition. For example, if a single pixel is configured with three sub-pixels emitting different color lights, a pixel structure including one sub-pixel extending in a vertical direction, and the other two sub-pixels extending in horizontal directions perpendicular to the vertically extended sub-pixel, the other two sub-pixels arranged in a parallel direction with the vertically extended sub-pixel, can be applied to the OLED display device. Such a pixel structure can allow a high definition OLED display device to be easily fabricated. This results from the fact that the distance between openings of a fine metal mask can be maximized and the sub-pixels can be densely (or closely) formed even though the fabrication and use of the fine metal mask are considered, when organic emission layers emitting different color lights are independently deposited in the sub-pixels using the fine metal mask.

Color and brightness of a pixel depend on combination of the sub-pixels. In other words, desired color and brightness of a pixel can be obtained by controlling the color and brightness of sub-pixels included in the pixel. As the definition gradually becomes higher, interference between adjacent sub-pixels may be caused by varying color and brightness of the sub-pixels. As such, the desired color and brightness of the pixel cannot be obtained. As the definition becomes higher, a pixel driver must be configured in such a manner that a source node (or a source wiring) connecting an electrode of an OLED of a sub-pixel and a driving thin film transistor overlaps with a data line. As such, a parasitic capacitance may be generated between the source node and the data line. Therefore, it may be difficult to perform an accurate color reproduction.

To address the above-mentioned problems without reducing the definition of an OLED display device and the density of sub-pixels, the present disclosure proposes a new pixel arrangement design suitable for applying to the OLED display device. The new pixel arrangement of the present disclosure allows the OLED display device to include pixels which are arranged in horizontal and vertical directions and each of the pixels configured with a single vertically extended sub-pixel and two laterally extended sub-pixels. The new pixel arrangement of the present disclosure enables not only two adjacent sub-pixels to share a single high potential voltage line, which is used to transfer a fixed voltage, but also the high potential voltage line to be disposed between two data lines which are used to transfer variable data voltages. Since the high potential voltage line used to transfer the fixed voltage is shared by the two adjacent sub-pixels, the OLED display device can realize high definition. Also, the high potential voltage line disposed between the two adjacent data lines can shield an electric field variation which is caused by varying the data voltage of one of the data lines. As such, the high potential voltage line disposed between the two data lines can prevent electric field interference between the two adjacent data lines. Moreover, as the high potential voltage line is disposed between the two adjacent data lines and shared by the two adjacent sub-pixels, a source node (or a wiring and an electrode) of each sub-pixel can be separated from a data line which is connected to an adjacent sub-pixel. As such, a parasitic capacitance generated between the source node of each sub-pixel and the data line for the adjacent sub-pixel can be minimized. Therefore, interference between the sub-pixels due to the variation of the data voltage can be efficiently reduced.

Structure of Organic Light Emitting Diode

FIG. 1 is a schematic diagram showing the structure of an organic light emitting diode (OLED).

The OLED can include organic compound layers formed between an anode electrode and a cathode electrode. The organic compound layers can include a hole injection layer (HIL), a hole transport layer (HTL), an emission layer (EML), an electron transport layer (ETL) and an electron injection layer (EIL).

According to a light emission principle, when a driving voltage is applied between the anode and the cathode, holes passing through the hole transport layer (HTL) and electrons passing through the electron transport layer (ETL) are drifted into the emission layer (EML). As such, excitons are formed within the emission layer (EML). In accordance therewith, visible light can be emitted from the emission layer (EML).

An OLED display device is configured with pixels which are arranged in a matrix shape, each pixel including the above-mentioned OLED. Brightness of the pixel selected by a scan pulse can be controlled on the basis of a gray scale value of image or image frame data.

Such an OLED display device can be classified as either a passive matrix mode or an active matrix mode. In the active matrix mode, thin film transistors are used as switching elements. Among the OLED display devices, the OLED display device of the active matrix mode selects the pixels by selectively turning-on the thin film transistors. The selected pixel can maintain a light emitting state using a voltage charged into a storage capacitor within the pixel.

Equivalent Circuit Diagram of Active Matrix Mode Pixel Driver

Figure 2:
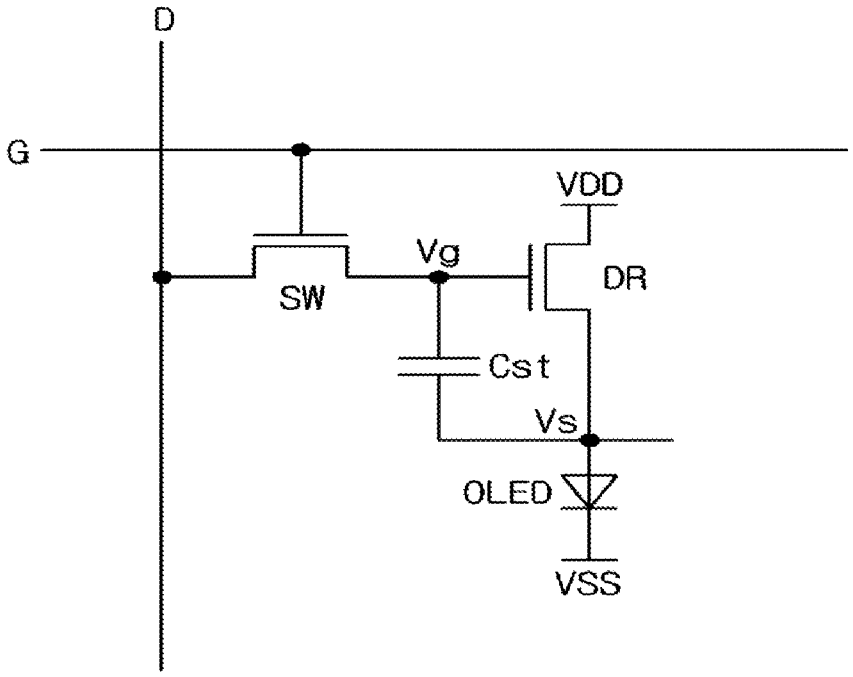
FIG. 2 is an equivalent circuit diagram showing a single pixel included in an OLED display device of an active matrix mode.

FIG. 2 is an equivalent circuit diagram showing a pixel driver included in an organic light emitting diode (OLED) display device of an active matrix mode.

The pixel driver within the OLED display device of the active matrix mode includes an organic light emitting diode (OLED), data line (D) and gate line (G) arranged to cross each other, switching thin film transistor (SW) and driving thin film transistor (DR) to repeatedly transfer data signals to the OLED, and a storage capacitor (Cst) configured to store and maintain the data signal during a fixed interval. The switching thin film transistor (SW) can be used as a scan switch, and the driving thin film transistor (DR) can be used as a driving switch.

The OLED shown in FIG. 2 can be formed in a common cathode connection structure which allows the OLEDs of the pixels to be connected to a common cathode electrode, but it is not limited to this.

Meanwhile, the switching thin film transistor (SW) and the driving thin film transistor (DR) can be n-type metal-oxide-semiconductor field-effect transistors (MOSFETs). In detail, the driving thin film transistor (DR) can be one of a low temperature polysilicon (LTPS) thin film transistor, an oxide thin film transistor and an amorphous silicon (a-Si) thin film transistor. Alternatively, the switching thin film transistor (SW) and the driving thin film transistor (DR) can be p-type MOSFETs. In this case, the switching and driving thin film transistors can be LTPS thin film transistors. Although it will be described that n-type thin film transistors are used as the switching thin film transistors (SW) and driving thin film transistors (DR), but the present disclosure is not limited to this.

Such pixel driver is simplified in a two transistor—one capacitor (2T-1C) configuration including transistors SW and DR and capacitor Cst.

According to a driving principle of the pixel driver, the switching thin film transistor (SW) is turned-on (or activated) in response to a scan pulse from the gate line (G). As such, a current path between a source electrode and a drain electrode of the switching thin film transistor (SW) is formed.

During a turned-on time interval of the switching thin film transistor (SW), a data voltage is transferred from the data line (D) to a gate electrode of the driving thin film transistor (DR) and to a first node corresponding to a connection node of the storage capacitor (Cst), the gate electrode of the driving thin film transistor (DR) and the source electrode of the switching thin film transistor (SW) via the drain electrode and the source electrode of the switching thin film transistor (SW).

The driving thin film transistor (DR) controls a current flowing through the OLED on the basis of a different voltage (Vgs) between the gate electrode and a source electrode of the driving thin film transistor (DR).

The storage capacitor (Cst) stores the data voltage applied to one of its electrodes. The storage capacitor (Cst) constantly maintains the voltage being applied to the gate electrode of the driving thin film transistor (DR) during a single frame period.

The OLED with the structure shown in FIG. 1 is connected between the source electrode of the driving thin film transistor (DR) and a low potential voltage source (VSS).

The brightness of the pixel is proportional to a current flowing through the OLED. The current depends on a gate-source voltage (Vgs) of the driving thin film transistor (DR).

The brightness of the pixel is proportioned to the current flowing through the OLED, as represented by the following equation 1.

$$V_{gs} = V_g - V_s \qquad \text{[Equation 1]}$$

$$V_g = V_{data},\ V_s = V_{init}$$

$$I_{oled} = \frac{\beta}{2}(V_{gs} - V_{th})^2 = \frac{\beta}{2}(V_{data} - V_{init} - V_{th})^2$$

In equation 1, 'Vgs' is the differential voltage between a gate voltage (Vg) and a source voltage (Vs) of the driving thin film transistor (DR), 'Vdata' is a data voltage, and 'Vinit' is an initialization voltage. Also, 'Ioled' is a driving current of the OLED, 'Vth' is a threshold voltage of the driving thin film transistor (DR), and 'β' is a constant value which is determined by mobility and parasitic capacitance of the driving thin film transistor (DR).

As illustrated in the equation 1, it is evident that the current Ioled of the OLED is largely affected by the threshold voltage (Vth) of the driving thin film transistor (DR). As such, uniformity of an entire image can depend on deviations in properties and threshold voltages of the driving thin film transistors (DR).

In order to compensate for the property deviation of the driving thin film transistor (DR), either an internal compensation mode or an external compensation mode can be applied to the pixel driver. The pixel driver can further include either a thin film transistor or a capacitor according to whether the internal compensation mode or external compensation mode is applied.

Block Diagram of Organic Light Emitting Diode (OLED) Display Device

Figure 3:
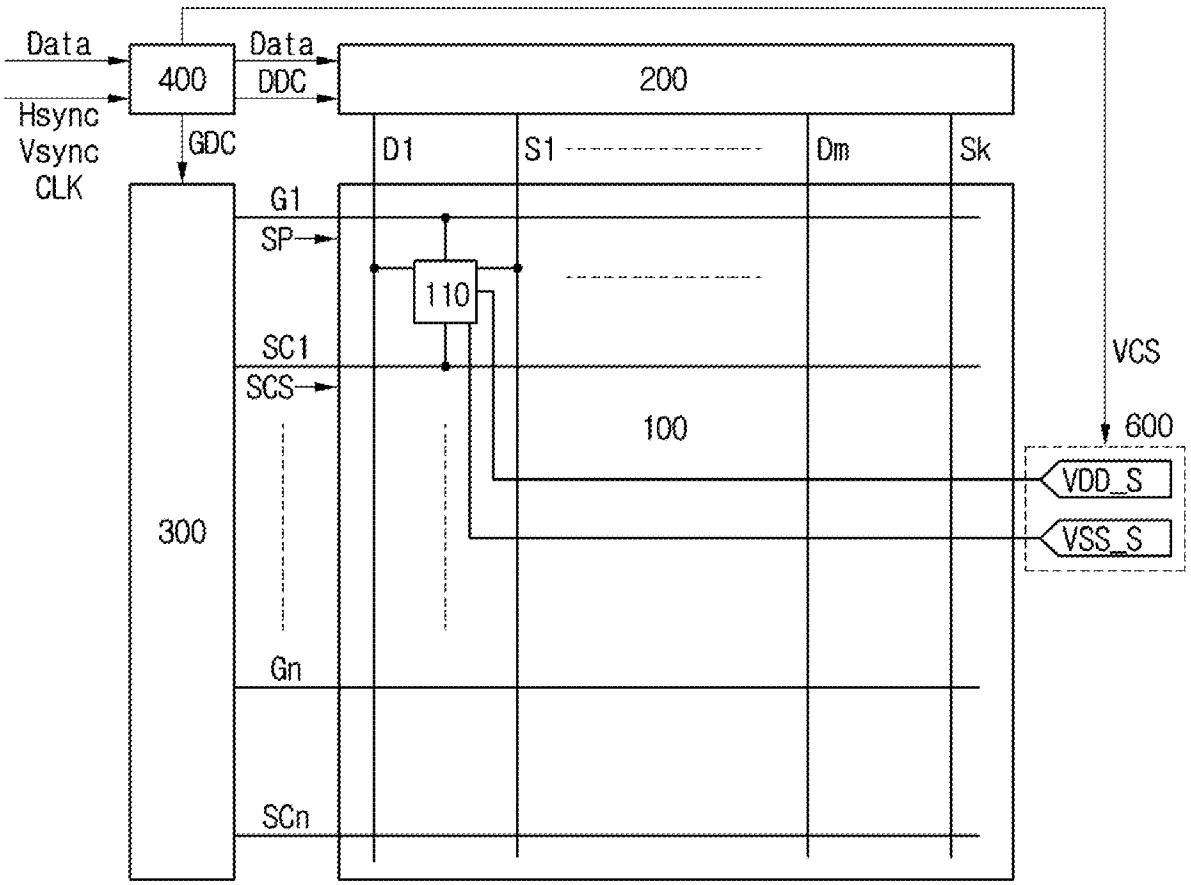
FIG. 3 is a block diagram showing an OLED display device according to an embodiment of the present disclosure.

FIG. 3 is a block diagram showing an organic light emitting diode (OLED) display device, according to an embodiment of the present disclosure.

An OLED display device according to an embodiment of the present disclosure can include a display panel 100, a data driver 200, a gate driver 300 and a timing controller 400.

The display panel 100 can include 'm' data lines D1~Dm, 'k' sensing lines S1~Sk, 'n' gate lines G1~Gn, 'n' sensing control lines SC1~SCn and 'm×n' pixel drivers 110. The sensing lines (S1~Sk) can be arranged at least at every two data lines. For example, the sensing lines (S1~Sk) can be arranged every four data lines. In this case, the 'm' data lines (D1~Dm) and the 'k' sensing lines (S1~Sk) can be distinguished into 'k' groups. Meanwhile, the gate lines (G1~Gn) and the sensing control lines (SC1~SCn) are arranged alternately with each other and grouped into 'n' pairs. The 'm×n' pixel drivers 110 are formed in regions which are defined by the 'm' data lines (D1~Dm) and the 'n' pairs of gate lines (G1~Gn) and sensing control lines (SC1~SCn) crossing each other. Each of the sensing line (S) can be shared by at least two pixels which are continuously arranged in a horizontal direction. Of course, the specific arrangement of such lines can be varied in many ways depending upon panel size, panel properties, desired display characteristics, and the like.

Signal lines used to transfer a high potential voltage (VDD) to each of the pixel drivers 110 and signal lines used to transfer a low potential voltage (VSS) to each of the pixel drivers 110 can be formed on the display panel 100. The high potential voltage (VDD) is used as a current driving voltage for generating a current which flows through the OLED. The high potential voltage (VDD) can be generated in a high potential voltage generator (VDD_S) within a power supply 600. The low potential voltage (VSS) can be generated in a low potential voltage generator (VSS_S) within the power supply 600. The power supply 600 replies to a voltage control signal (VCS) supplied from the timing controller 400 and adjusts levels of the high potential voltage (VDD) and the low potential voltage (VSS) which are applied to the pixel drivers 110.

The gate driver 300 can generate scan pulses in response to gate control signals (GDC) from the timing controller 400. The scan pulses can be sequentially applied to the gate lines (G1~Gn). Also, the gate driver 300 can generate sensing control signals (SCS) under control of the timing controller 400. The sensing control signal (SCS) is used to control a sensing thin film transistor (ST) included in each of the pixels drivers 110.

Although it is explained that the gate driver 300 outputs both of the scan pulses (SP) and the sensing control signal (SCS), the present disclosure is not limited to this. Alternatively, the OLED display device can further include a sensing thin film transistor (TFT) control driver which outputs the sensing control signals (SCS) under control of the timing controller 400.

The data driver 200 can be controlled by data control signals (DDC) supplied from the timing controller 400. Also, the data driver 200 can supply data voltages to the data lines (D1~Dm). Moreover, the data driver 200 can not only apply an initialization voltage to the sensing lines (S1~Sk) but also detect sensing voltages through the sensing lines (S1~Sk). Alternatively, the data driver 200 can apply a reference voltage to the pixel drivers through the sensing lines (S1~Sk). The data lines (D1~Dm) are connected to the pixel drivers 110. As such, the data voltages can be applied to the pixel drivers 110 via the data lines (D1~Dm) which are connected to the pixel drivers 110.

The driving thin film transistors (DR) causing brightness non-uniformity between the OLEDs can be compensated by either the internal composition mode or the external compensation mode. The internal compensation mode can apply a reference voltage to each of the sensing lines (S1~Sk) in synchronization with the sensing control signal (SCS) applied to one of the sensing control lines (SC1~SCn). The external compensation mode can apply an initialization voltage to the pixel drivers 110 via the sensing lines (S1~Sk) and then detect sensing voltages on the sensing lines (S1~Sk). In detail, the pixel driver 110 is charged with the initialization voltage on the respective sensing line (S) and then enters into a floating state. In accordance therewith, the sensing voltage can be sensed.

Although it is explained that the data driver 200 can output the data voltages and the initialization voltage and detect the sensing voltages, the present disclosure is not limited to this. Alternatively, the OLED display device can further include a sensing driver which outputs the initialization voltage and detects the sensing voltages.

Pixel Arrangement According to a First Embodiment

Figure 4:
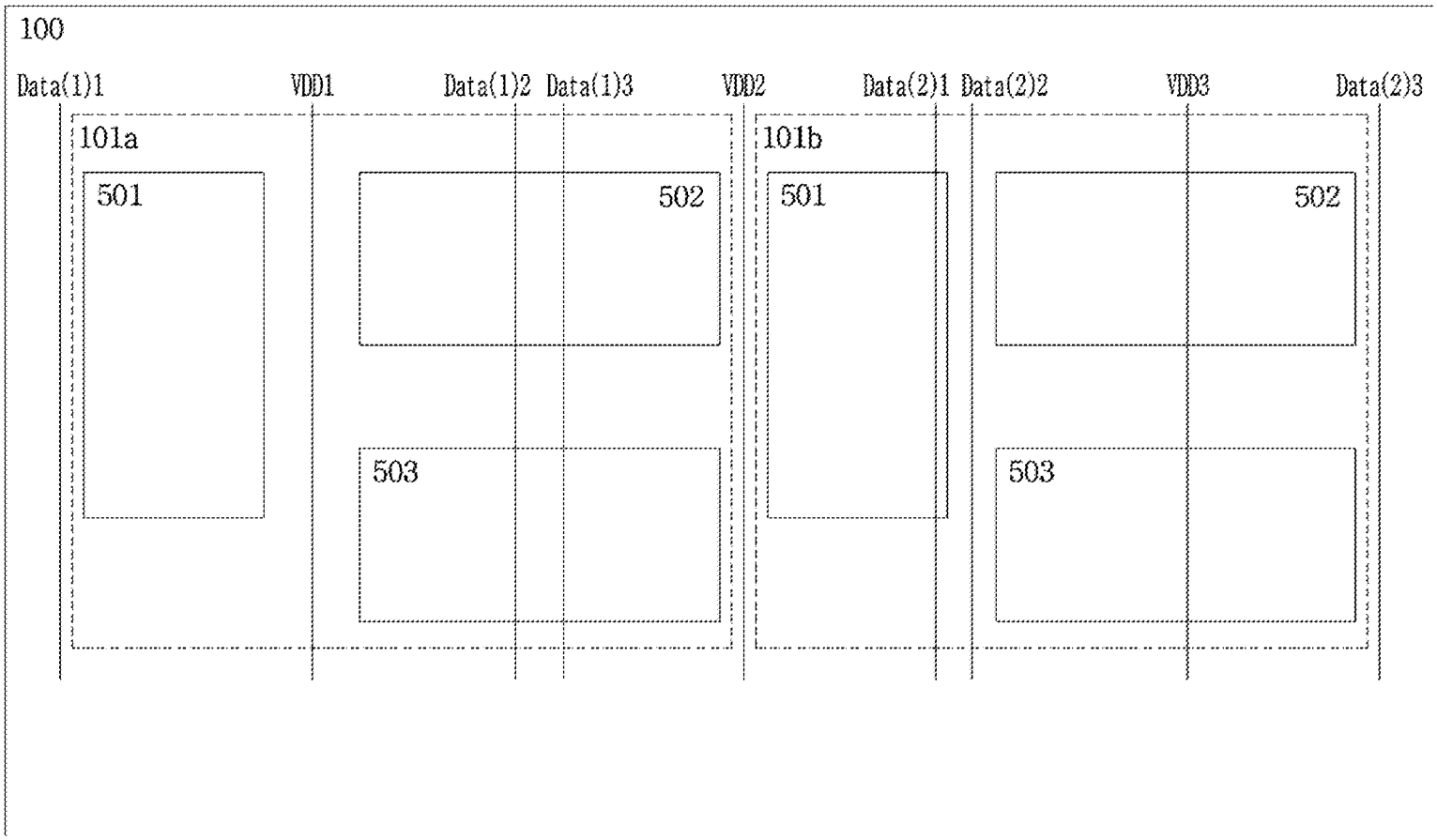
FIG. 4 is a planar view of pixel arrangements showing an arrangement of data lines, power supply lines and pixel electrodes, according to an embodiment of the present disclosure.
Figure 5:
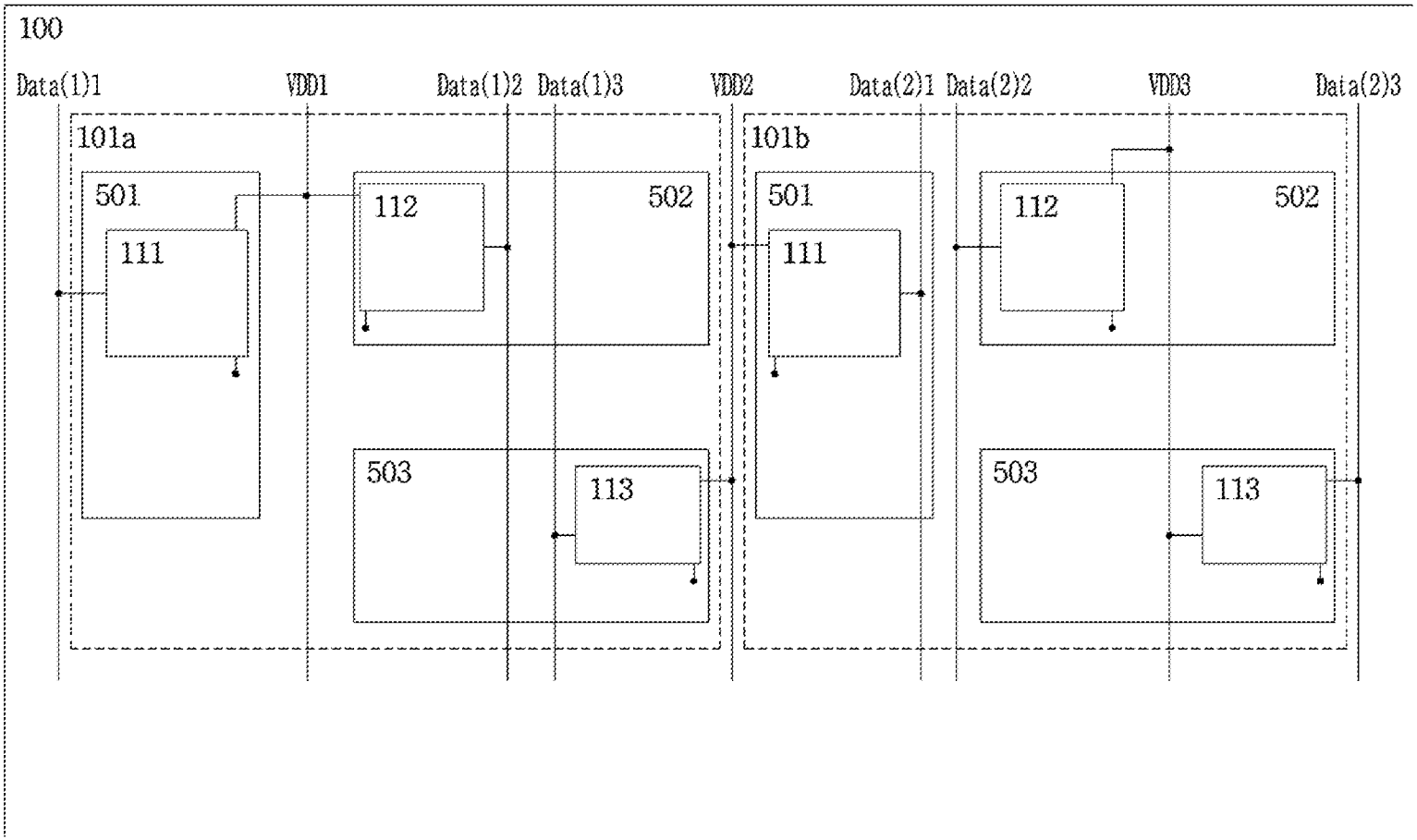
FIG. 5 is a planar view of pixel arrangements showing an arrangement of data lines, power supply lines, pixel electrodes and pixel drivers, according to an embodiment of the present disclosure.
Figure 6:
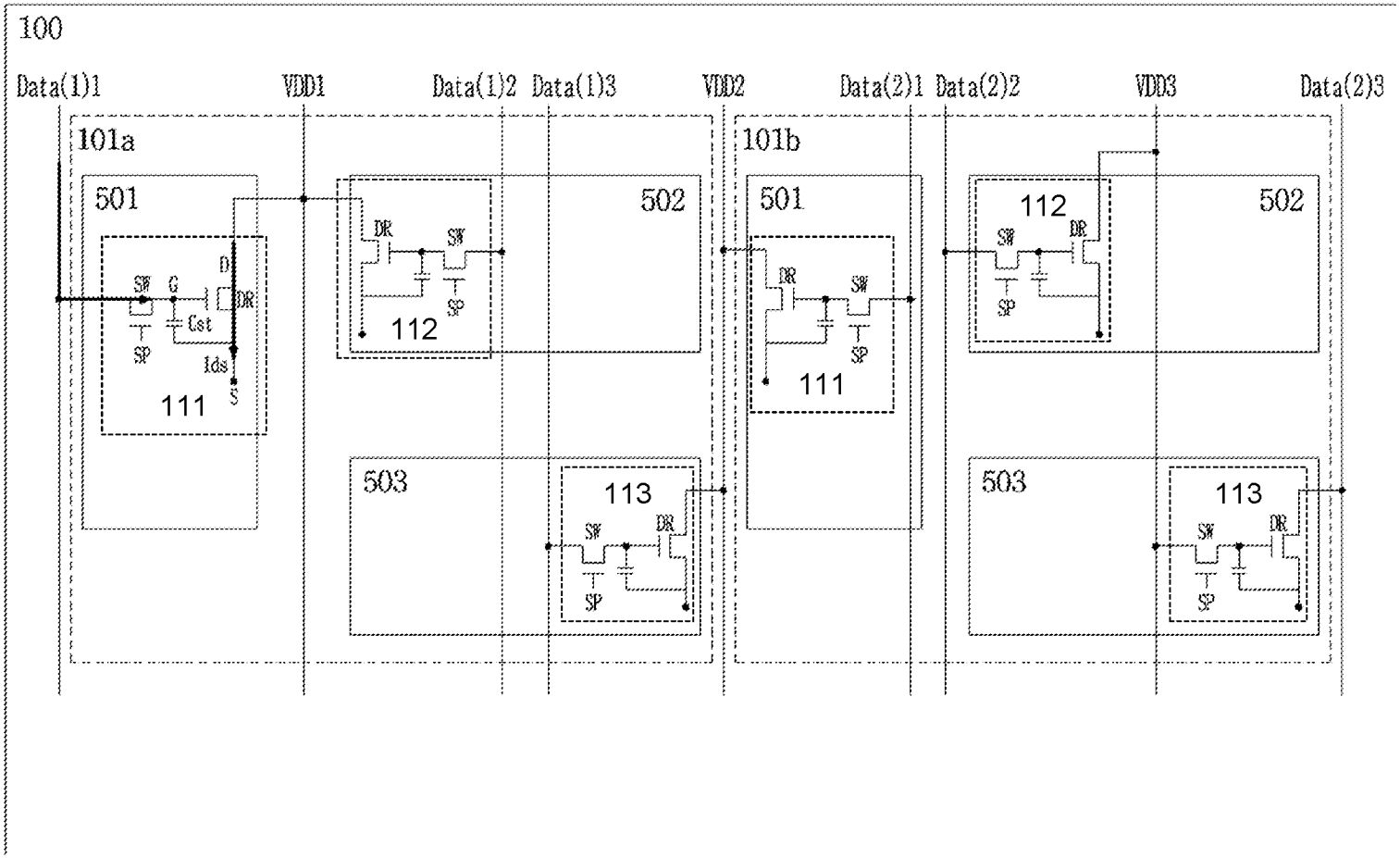
FIG. 6 is a detail circuit diagram showing the pixel drivers of FIG. 5.
Figure 7:
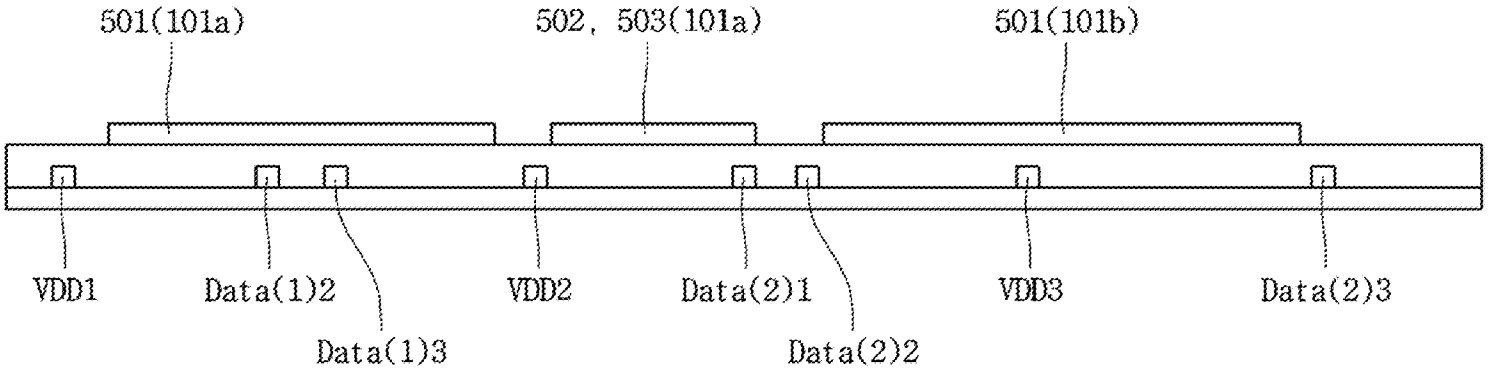
FIG. 7 is a cross-sectional view showing the display panel of FIG. 4.

FIGS. 4 through 6 are planar views showing examples of pixel arrangements according to an embodiment of the present disclosure. FIG. 4 is a planar view of pixel arrangements showing an arrangement of data lines, power supply lines and pixel electrodes. FIG. 5 is a planar view of pixel arrangements showing an arrangement of data lines, power supply lines, pixel electrodes and pixel drivers. FIG. 6 is a detail circuit diagram showing the pixel drivers of FIG. 5. FIG. 7 is a cross-sectional view showing the display panel of FIG. 4.

Referring to FIGS. 4 and 7, an OLED display panel 100 according to a first embodiment of the present disclosure includes a display area 101 defined into a plurality of pixel regions 101*a* and 101*b*. For example, the display area 101 can include an odd-numbered pixel region (hereinafter, "first pixel region") 101*a* and an even-numbered pixel region (hereinafter, "second pixel region") 101*b* which are arranged adjacently to each other in a horizontal (e.g., row) direction. Although it is explained that only the first pixel region 101*a* and the second pixel region 101*b* are arranged in the display area 101 as shown in FIG. 4, the present disclosure is not limited to this. In other words, the first and second pixel regions 101*a* and 101*b* can be repeatedly arranged within the display area 101 along horizontal (e.g., row) and vertical (e.g., column) directions.

First through third pixel electrodes 501, 502 and 503 can be arranged in each of the first and second pixel regions 101*a* and 101*b*. Each of the first through third pixel electrodes 501, 502 and 503 can be used as the anode electrode shown in FIG. 1. In other words, each of the first through third pixel electrodes 501, 502 and 503 can become an anode electrode of the OLED described in FIG. 2. Each of the first through third pixel electrodes 501, 502 and 503 can be connected to a source electrode of a driving thin film transistor (DR) within each of the pixel driver 110.

Also, each of the first through third pixel electrodes 501, 502 and 503 can be a pixel electrode which is included in one of red, green and blue sub-pixels. For example, the first pixel electrode 501 can be included in the blue sub-pixel, the second pixel electrode 502 can be included in the green sub-pixel, and the third pixel electrode 503 can be included in the red sub-pixel. However, the present disclosure is not limited to this.

The first through third pixel electrode 501, 502 and 503 can have different areas (i.e., space or footprint) from one another without being limited to areas which are shown in the drawings. In other words, the areas of the first through third pixel electrodes 501, 502 and 503 can depend on the brightness and properties of each color of the respective pixel electrode.

In the arrangement of data lines and power supply lines, a first set of data lines Data(1) including first through third data lines Data(1)1, Data(1)2 and Data(1)3, and a second set of data lines Data(2) including first through third data lines Data(2)1, Data(2)2 and Data(2)3 is allotted to each of the pixel regions 101*a* and 101*b*. The data lines Data(1), Data(2) can be disposed adjacently to one of the other data lines. Also, the data lines can be arranged in pairs between first through third power supply lines VDD1, VDD2 and VDD3 which are used to transfer a high potential voltage (VDD).

The first power supply line (VDD1) can be disposed within the first pixel region 101*a*. The second power supply line (VDD2) can be disposed in a boundary region between the first pixel region 101*a* and the second pixel region 101*b*. The third power supply line (VDD3) can be disposed within the second pixel region 101*b*.

Meanwhile, the first data line Data(1)1 allotted to the first pixel region 101*a* can be disposed in a boundary region between the first pixel region 101*a* and a previous pixel region adjacent to the first pixel region 101*a* in a horizontal direction. Since the first pixel region 101*a* corresponds to a first pixel as shown in the drawing, the first data line Data(1)1 can be disposed in one edge of the display area 101. The third data line Data(2)3 allotted to the second pixel region 101*b* can be disposed in another boundary region between the second pixel region 101*b* and a next pixel region adjacent to the second pixel region 101*b* in the horizontal direction.

The first pixel electrode 501 within the first pixel region 101*a* can be disposed between the first data line Data(1)1 allotted to the first pixel region 101*a* and the first power supply line VDD1. The second and third data lines Data(1)2 and Data(1)3 allotted to the first pixel region 101*a* can be disposed between the first power supply line VDD1 and the second power supply line VDD2. The second and third pixel electrodes 502 and 503 within the first pixel region 101*a* can be disposed in such a manner as to overlap with the second and third data lines Data(1)2 and Data(1)3 allotted to the first pixel region 101*a*.

The first pixel electrode 501 within the second pixel region 101*b* can be disposed between the second power supply line VDD2 and the first data line Data(2)1 allotted to the second pixel region 101*b*. Although it is shown in the drawings that the first pixel electrode 501 within the second pixel region 101*b* overlap with the first data line Data(2)1 allotted to the second pixel region 101*b*, it is not limited to this. The second and third pixel electrodes 502 and 503 within the second pixel region 101*b* can be disposed between the second and third data lines Data(2)2 and Data(2)3 allotted to the second pixel region 101*b*. Also, the second and third pixel electrodes 502 and 503 can be disposed in such a manner as to overlap with the third power supply line VDD3.

The second pixel electrode 502 and the third pixel electrode 503 of both the first pixel region 101*a* and the second pixel region 101*b* are disposed along a first direction parallel to a major axis of the first pixel electrode 501. Also, the second pixel electrode 502 and the third pixel electrode 503 can be formed to expand parallel to each other in a second direction perpendicular to the first direction.

Referring to FIG. 4, the display area 101 of the display panel 100 according to a first embodiment of the present disclosure can be defined to include the first pixel region 101*a* and the second pixel region 101*b*. The display panel 100 can include first through third sub-pixels which are arranged within each of the first and second pixel regions 101*a* and 101*b* and display different colors. The first sub-pixel can have a major axis crossing directions which extends from major axes of the second and third sub-pixels. The major axes of the second and third sub-pixels can be disposed parallel to each other.

The display panel 100 further include three power supply lines VDD1, VDD2 and VDD3 and six data lines Data(1)1, Data(1)2, Data(1)3, Data(2)1, Data(2)2 and Data(2)3 which cross an arrangement direction of the first and second pixel regions 101*a* and 101*b*. In other words, the three power supply lines VDD1, VDD2 and VDD3 and the six data lines Data(1)1, Data(1)2, Data(1)3, Data(2)1, Data(2)2 and Data(2)3 can be arranged to each penetrate through one of the first and second pixel regions 101*a* and 101*b*. The three power supply lines VDD1, VDD2 and VDD3 and the six data lines Data(1)1, Data(1)2, Data(1)3, Data(2)1, Data(2)2 and Data(2)3 can be arranged parallel to one another.

One of the three power supply lines VDD1, VDD2 and VDD3 can transfer the high potential voltage (VDD) to two of the first through third sub-pixels. One of the six data lines Data(1)1, Data(1)2, Data(1)3, Data(2)1, Data(2)2 and Data(2)3 can transfer the data voltage to one of the first through third sub-pixels.

The three power supply lines VDD1, VDD2 and VDD3 and six data lines Data(1)1, Data(1)2, Data(1)3, Data(2)1, Data(2)2 and Data(2)3 can be repeatedly arranged along the arrangement direction of the first and second pixel regions 101*a* and 101*b* in a sequence of data line, power supply line and data line. In detail, the three power supply lines VDD1, VDD2 and VDD3 and the six data lines Data(1)1, Data(1)2, Data(1)3, Data(2)1, Data(2)2 and Data(2)3 can be arranged in a sequence of one data line Data(1)1, one power supply line VDD1, another two data lines Data(1)2 and Data(1)3, another power supply line VDD2, still another two data lines Data(2)1 and Data(2)2, the other one power supply line VDD3 and the other one data line Data(2)3.

As shown in FIG. 5, the display panel 100 can include first through third pixel drivers 111, 112 and 113 used to drive the first through third pixel electrodes 501, 502 and 503 within each of the pixel regions 101*a* and 101*b*. The first pixel driver 111 can be configured to drive the first pixel electrode 501, the second pixel driver 112 can configured to drive the second pixel electrode 502, and the third pixel driver 113 can be configured to drive the third pixel electrode 503.

Two pixel drivers among the pixel drivers 111, 112 and 113 arranged within a single pixel region 101 can share one power supply line VDD with each other, and the other one pixel driver can share another power supply line VDD with one pixel driver within an adjacent pixel region thereto. As such, the pixel drivers within the pixel regions 101*a*, 101*b* can be allotted by a pair per a single power supply line regardless of the pixel regions 101*a* and 101*b*. In other words, each of the power supply lines VDD1, VDD2 and VDD3 can be shared by two pixel drivers regardless of the pixel regions 101*a* and 101*b*. In detail, the first pixel driver 111 and the second pixel driver 112 within the first pixel region 101*a* can share the first power supply line (VDD1). The third pixel driver 113 within the first pixel region 101*a* and the first pixel driver 111 within the second pixel region 101*b* can share the second power supply line (VDD2), and the second and third pixel drivers 112 and 113 within the second pixel region 101*b* can share the third power supply line (VDD3).

Referring to FIG. 6, the first pixel driver 111 allows a data voltage on the first data line Data(1)1 allotted to the first pixel region 101*a* to be applied to the gate electrode (G) of the driving thin film transistor (DR) through the switching thin film transistor (SW) which is turned-on by a scan pulse (SP). Also, the high potential voltage (VDD) on the first power supply line (VDD1) is applied to the drain electrode (D) of the driving thin film transistor (DR). As such, a current flowing through the driving thin film transistor (DR) is determined by the data voltage and the high potential voltage (VDD) and applied to the first pixel electrode 501 of the first pixel region 101*a* which is connected to the source electrode (S) of the driving thin film transistor (DR). In accordance therewith, the OLED can emit light. Such a driving mode of the first pixel driver 111 within the first pixel region 101*a* can be applied to the other pixel drivers within the first and second pixel regions 101*a* and 101*b*. In other words, not only the second and third pixel drivers 112 and 113 within the first pixel region 101*a* but also the pixel drivers 111, 112 and 113 within the second pixel region 101*b* can be driven in the same manner as the first pixel driver 111 within the first pixel region 101*a*.

Although it is shown and explained in the drawings that the second pixel driver 112 within the first pixel region 101*a* is connected to the first power supply line (VDD1) and the third pixel driver 113 within the first pixel region 101*a* is connected to the second power supply line (VDD2), the present disclosure is not limited to this. Alternatively, the second pixel driver 112 within the first pixel region 101*a* can be connected to the second power supply line (VDD2) and the third pixel driver within the first pixel region 101*a* can be connected to the first power supply line (VDD1). Also, it is shown and explained in the drawings that the second pixel driver 112 within the second pixel region 101*b* is connected to the second data line Data(2)2 allotted to the second pixel region 101*b* and the third pixel region 113 within the second pixel region 101*b* is connected to the third data line Data(2)3 allotted to the second pixel region 101*b*, but the present disclosure is not limited to this. In a different manner, the second pixel driver 112 within the second pixel region 101*b* can be connected to the third data line Data(2)3 allotted to the second pixel region 101*b* and the third pixel driver 113 within the second pixel region 101*b* can be connected to the second data line Data(2)2 allotted to the second pixel region 101*b*.

The display panel 100 according to a first embodiment of the present disclosure can allow the pixel drivers within two sub-pixels to share one power supply line. As such, an aperture ratio of the display panel 100 can be enhanced.

Also, two data lines are arranged adjacently to each other between two power supply lines, and two of three pixel electrodes within a single pixel region are arranged in a first direction parallel to the major axis of the other one pixel electrode and formed to extend in second directions perpendicular to the first direction. In accordance therewith, the density of pixels can become larger. Therefore, the aperture ratio of the display panel can be enhanced, and high definition can be realized.

Pixel Arrangement According to a Second Embodiment

Figure 8:
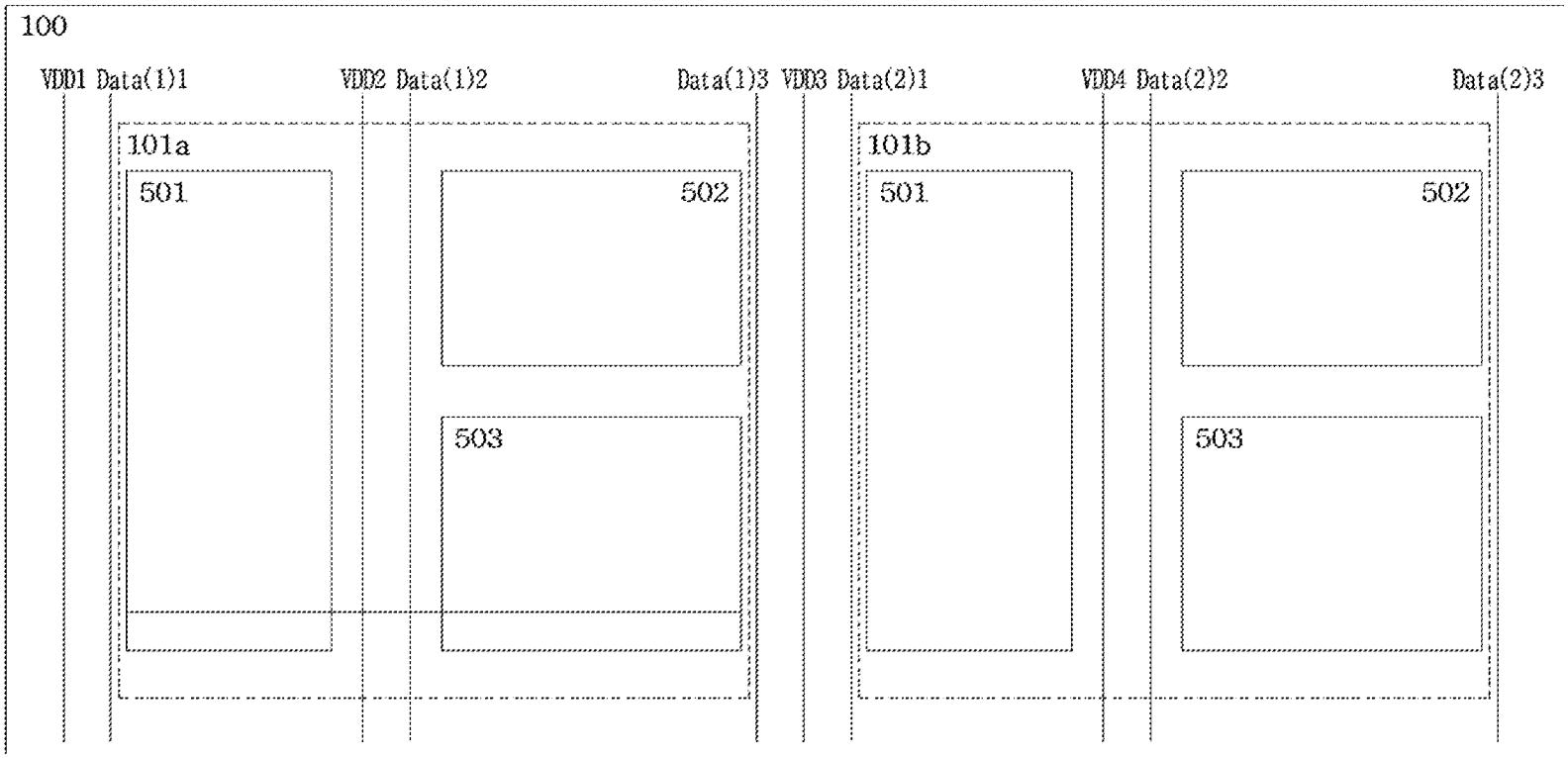
FIG. 8 is a planar view of pixel arrangements showing an arrangement of data lines, power supply lines and pixel electrodes, according to another embodiment of the present disclosure.
Figure 9:
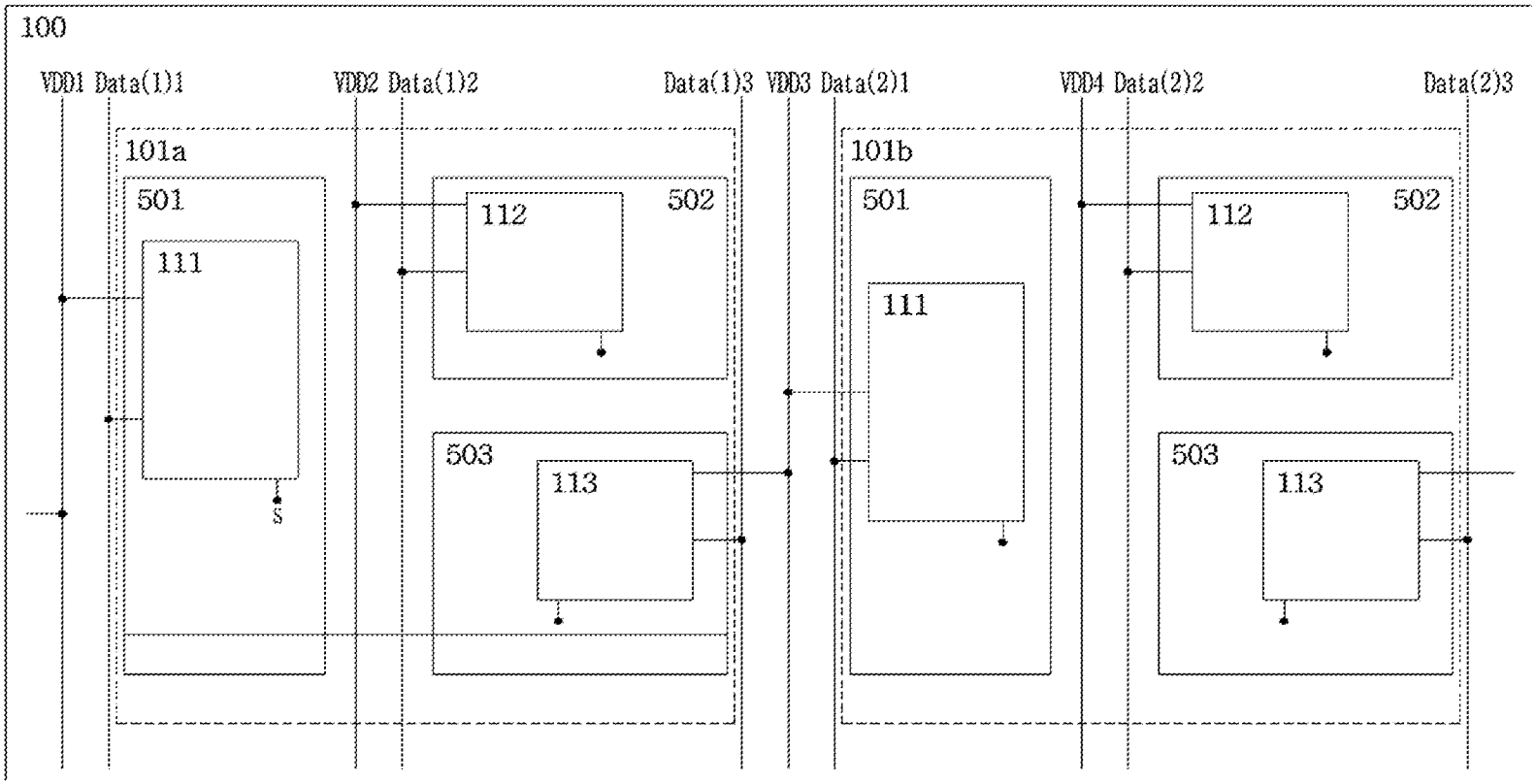
FIG. 9 is a planar view of pixel arrangements showing an arrangement of data lines, power supply lines, pixel electrodes and pixel drivers, according to another embodiment of the present disclosure.
Figure 10:
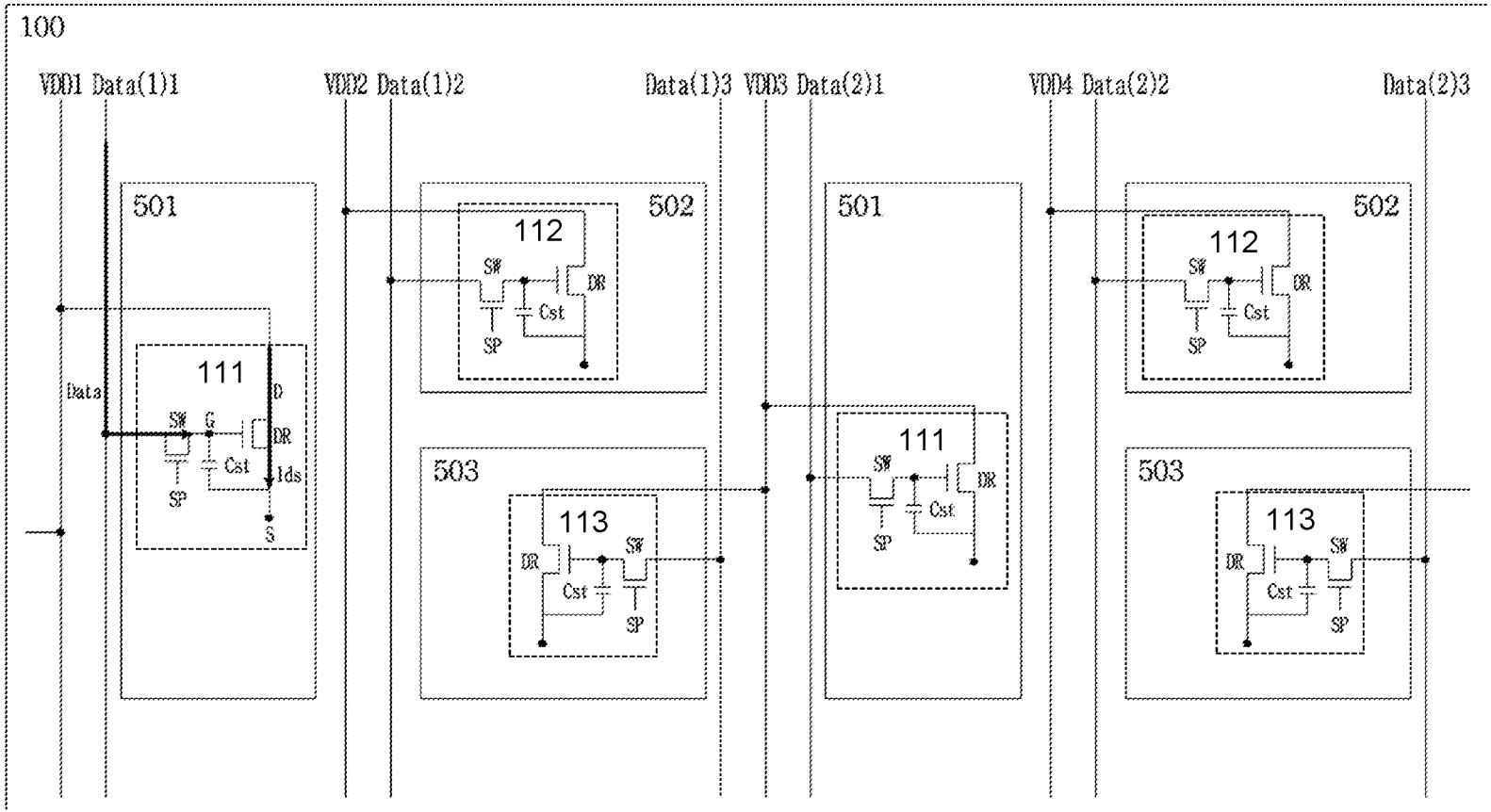
FIG. 10 is a detail circuit diagram showing the pixel drivers of FIG. 9.
Figure 11:
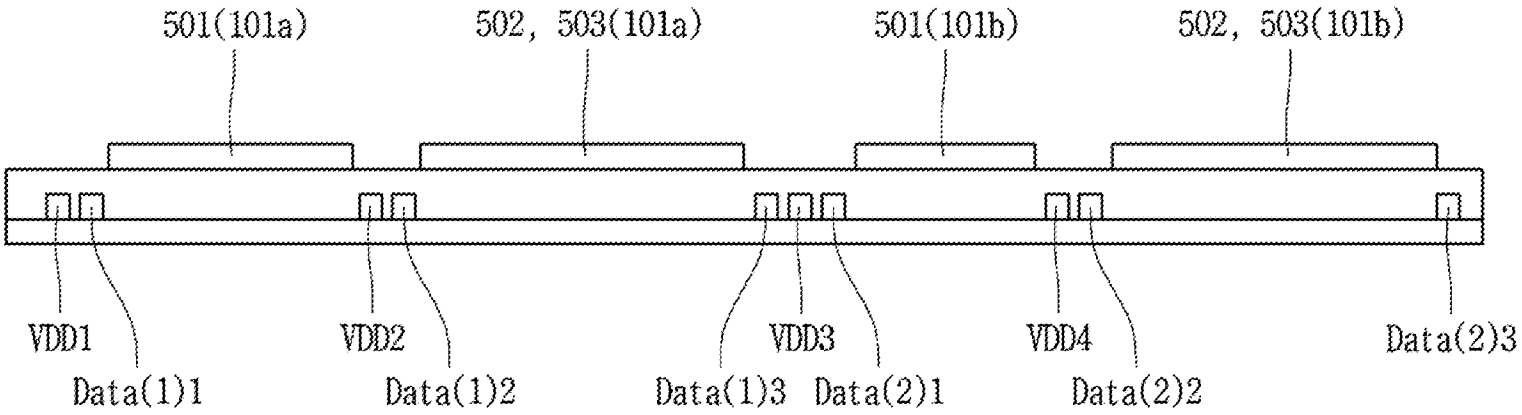
FIG. 11 is a cross-sectional view showing the display panel of FIG. 8.

FIGS. 8 through 10 are planar vies a pixel arrangement according to another embodiment of the present disclosure. FIG. 8 is a planar view of pixel arrangements showing an arrangement of data lines, power supply lines and pixel electrodes. FIG. 9 is a planar view of pixel arrangements showing an arrangement of data lines, power supply lines, pixel electrodes and pixel drivers. FIG. 10 is a detail circuit diagram showing the pixel drivers of FIG. 8. FIG. 11 is a cross-sectional view showing the display panel of FIG. 8.

Referring to FIGS. 8 and 11, an OLED display panel 100 according to a second embodiment of the present disclosure includes a display area 101 defined into a plurality of pixel regions 101*a* and 101*b*. For example, the display area 101 can include an odd-numbered pixel region (hereinafter, "first pixel region") 101*a* and an even-numbered pixel region (hereinafter, "second pixel region") 101*b* which are arranged along a horizontal direction. Although it is explained that only the first pixel region 101*a* and the second pixel region 101*b* are arranged in the display area 101 as shown in FIG. 8, the present disclosure is not limited to this. In other words, the first and second pixel regions 101*a* and 101*b* can be repeatedly arranged within the display area 101 along horizontal and vertical directions.

First through third pixel electrodes 501, 502 and 503 can be arranged in each of the first and second pixel regions 101*a* and 101*b*. Each of the first through third pixel electrodes 501, 502 and 503 can be used as the anode electrode shown in FIG. 1. In other words, each of the first through third pixel electrodes 501, 502 and 503 can become an anode electrode of the OLED described in FIG. 2. Each of the first through third pixel electrodes 501, 502 and 503 can be connected to a source electrode of a driving thin film transistor DR within each of the pixel driver 110.

Also, each of the first through third pixel electrodes 501, 502 and 503 can be a pixel electrode which is included in one of red, green and blue sub-pixels. For example, the first pixel electrode 501 can be included in the blue sub-pixel, the second pixel electrode 502 can be included in the green sub-pixel, and the third pixel electrode 503 can be included in the red sub-pixel. However, the present disclosure is not limited to this.

The first through third pixel electrode 501, 502 and 503 can have different areas from one another without being limited to areas which are shown in the drawings. In other words, the areas of the first through third pixel electrodes 501, 502 and 503 can depend on brightness and properties of each color of the respective pixel electrode.

In the arrangement of data lines and voltage supply lines, a first set of data lines Data(1) including data lines Data(1)1, Data(1)2, Data(1)3, and a second set of data lines Data(2) including Data(2)1, Data(2)2 and Data(2)3 within the display area 101 can be arranged adjacently to each other in pairs, every other pair in a boundary region between the pixel regions 101*a* and 101*b*. Also, the two data lines adjacent to each other (for example, a third data line Data(1)3 allotted to the first pixel region 101*a* and a first data line Data(2)1 allotted to the second pixel region 101*b*) can be disposed in a boundary region between the two pixel regions (for example, the first and second pixel regions 101*a* and 101*b*) adjacent to each other. Moreover, first through fourth power supply lines VDD1, VDD2, VDD3 and VDD4 can be disposed between the two data lines adjacent to each other in every other pair. Furthermore, the second and fourth power supply lines VDD2 and VDD4 can be disposed in such a manner as to cross the pixel regions 101*a* and 101*b*, respectively, and the first and third power supply lines VDD1 and VDD3 can be disposed in boundary regions between two pixel regions (for example, the third power supply VDD3 can be disposed in the boundary region between the pixel regions 101*a* and 101*b*).

The first pixel electrode 501 within the first pixel region 101*a* can be disposed between the first data line Data(1)1 allotted to the first pixel region 101*a* and the second power supply line VDD2. The second and third pixel electrodes 502 and 503 within the first pixel region 101*a* can be disposed between the second and third data lines Data(1)2 and Data(1)3 allotted to the first pixel region 101*a*. The first pixel electrode 501 within the second pixel region 101*b* can be disposed between the first data line Data(2)1 allotted to the second pixel region 101*b* and the fourth power supply line (VDD4). The second and third pixel electrodes 502 and 503 within the second pixel region 101*b* can be disposed between the second and third data lines Data(2)2 and Data(2)3 allotted to the second pixel region 101*b*.

In other words, the first through third pixel electrodes 501, 502 and 503 within each of the pixel regions 101*a* and 101*b* are arranged without overlapping with anyone of the data lines or the power supply lines.

The second pixel electrode 502 and the third pixel electrode 503 can be disposed in top and bottom sides within each of the pixel regions 101*a* and 101*b*. Also, the second and third pixel electrodes 502 and 503 together with the first pixel electrode 501 can be disposed in right and left sides within each of the pixel regions 101*a* and 101*b*.

As shown in FIG. 9, pixel drivers 111, 112 and 113 configured to drive the first through third pixel electrodes 501, 502 and 503 can be arranged in each of the pixel regions 101*a* and 101*b*. In detail, the first pixel driver 111 can be configured to drive the first pixel electrode 501, the second pixel driver 112 can be configured to drive the second pixel electrode 502, and the third pixel driver 113 can be configured to drive the third pixel electrode 503 can be arranged in each of the pixel regions 101*a* and 101*b*.

Two of the pixel drivers 111, 112 and 113 within each of the pixel regions 101*a* and 101*b* can be connected to power supply lines which are disposed in boundary regions between the pixel regions adjacent to one another. The other pixel driver can be connected to a power supply line crossing the respective pixel region.

In detail, the first pixel driver 111 within the first pixel region 101*a* can be connected to the first power supply line (VDD1). The third pixel driver 113 within the first pixel region 101*a* can be connected to the third power supply line (VDD3). The second pixel driver 112 within the first pixel region 101*a* can be connected to the second power supply line (VDD2).

Similarly to the first pixel region 101*a*, the first pixel driver 111 within the second pixel region 101*b* can be connected to the third power supply line (VDD3). The third pixel driver 113 within the second pixel region 101*b* can be connected to another power supply line (not shown) which is disposed in a boundary region between the second pixel region 101*b* and the next pixel region adjacent thereto in a horizontal direction. The second pixel driver 112 within the second pixel region 101*b* can be connected to the fourth power supply line (VDD4).

Also, the first pixel driver 111 within the first pixel region 101*a* can be connected to the first data line Data(1)1 which is adjoined to the first power supply line (VDD1) and allotted to the first pixel region 101*a*. The third pixel driver 113 within the first pixel region 101*a* can be connected to the third data line Data(1)3 which is adjoined to the third power supply line (VDD3) and allotted to the first pixel region 101*a*. The second pixel driver 112 within the first pixel region 101*a* can be connected to the second data line Data(1)2 which is adjoined to the second power supply line VDD2 and allotted to the first pixel region 101*a*.

Similarly to the first pixel region 101*a*, the first pixel driver 111 within the second pixel region 101*b* can be connected to the first data line Data(2)1 which is adjoined to the third power supply line (VDD3) and allotted to the second pixel region 101*b*. The third pixel driver 113 within the second pixel region 101*b* can be connected to the third data line Data(2)3 which is allotted to the second pixel region 101*b* and adjoined to another power supply line being disposed on a boundary region between the second pixel region 101*b* and the next pixel region adjacent thereto in a horizontal direction. The second pixel driver 112 within the second pixel region 101*b* can be connected to the second data line Data(2)2 which is adjoined to the fourth power supply line VDD4 and allotted to the second pixel region 101*b*.

Referring to FIG. 10, the first pixel driver 111 within the first pixel region 101*a* allows a data voltage Data on the first data line Data(1)1 allotted to the first pixel region 101*a* to be applied to the gate electrode (G) of the driving thin film transistor (DR) through the switching thin film transistor (SW) which is turned-on by a scan pulse (SP). Also, the high potential voltage (VDD) on the first power supply line (VDD1) is applied to the drain electrode (D) of the driving thin film transistor (DR). As such, a current (Ids) flowing through the driving thin film transistor (DR) is determined by the data voltage Data and the high potential voltage (VDD) and applied to the first pixel electrode 501 of the first pixel region 101*a* which is connected to the source electrode (S) of the driving thin film transistor (DR). In accordance therewith, the organic OLED can emit light. Such a driving mode of the first pixel driver 111 within the first pixel region 101*a* can be applied to the other pixel drivers within the first and second pixel regions 101*a* and 101*b*. In other words, not only the second and third pixel drivers 112 and 113 within the first pixel region 101*a* but also the pixel drivers 111, 112 and 113 within the second pixel region 101*b* can be driven in the same manner as the first pixel driver 111 within the first pixel region 101*a*.

Although it is shown and explained in the drawings that the second pixel driver 112 within the first pixel region 101*a* is connected to the second power supply line (VDD2) and the third pixel driver 113 within the first pixel region 101*a* is connected to the third power supply line (VDD3), the present disclosure is not limited to this. Alternatively, the second pixel driver 112 within the first pixel region 101*a* can be connected to the third power supply line (VDD3) and the third pixel driver within the first pixel region 101*a* can be connected to the second power supply line (VDD2). Also, it is shown and explained in the drawings that the second pixel driver 112 within the second pixel region 101*b* is connected to the second data line Data(2)2 allotted to the second pixel region 101*b* and the third pixel region 113 within the second pixel region 101*b* is connected to the third data line Data(2)3 allotted to the second pixel region 101*b*, but the present disclosure is not limited to this. In a different manner, the second pixel driver 112 within the second pixel region 101*b* can be connected to the third data line Data(2)3 allotted to the second pixel region 101*b* and the third pixel driver 113 within the second pixel region 101*b* can be connected to the second data line Data(2)2 allotted to the second pixel region 101*b*.

The display panel 100 according to a second embodiment of the present disclosure can allow the pixel drivers included in two of three sub-pixels within a single pixel region to share one power supply line. As such, the aperture ratio of the display panel 100 can be enhanced.

Also, data interference between two data lines adjacent to each other can be minimized by disposing a power supply line between the two data lines. In detail, the power supply used to transfer a fixed voltage is disposed between the two data lines used to transfer different data voltages (or different data signals) from each other. As such, variation of a magnetic field due to a time-varying data signal can be prevented because a magnetic field around the data lines is constantly fixed.

Such a power supply line disposed between the two data lines adjacent to each other can reduce a distance between the two data lines. As such, the density of pixels can become larger. Therefore, high definition can be realized and color gamut can be enhanced.

Moreover, the data line and the pixel electrode cannot overlap with each other. As such, a parasitic capacitance can be minimized. Therefore, signal interference due to the parasitic capacitance can be prevented.

Furthermore, two data lines adjacent to each other can be disposed in a boundary between pixel regions. Two of three pixel electrodes within a single pixel region can be arranged in a vertical direction, the vertically arranged pixel electrodes and the other pixel electrode can be arranged in right and left sides of the single pixel region. In accordance therewith, the density of pixels can become larger. Therefore, high definition can be realized and the aperture ratio of the display panel can be enhanced.

Although the present disclosure has been limitedly explained regarding only the embodiments described above, it should be understood by an ordinary skilled person in the art that the present disclosure is not limited to these embodiments, but rather that various changes or modifications thereof are possible without departing from the scope of the present disclosure. Accordingly, the scope of the present disclosure shall be determined only by the appended claims and their equivalents without being limited to the description of the present disclosure.

What is claimed is:

1. A display panel comprising:

an array of pixels configured as a matrix having a column direction and a row direction, each pixel having a first sub-pixel, a second sub-pixel and a third sub-pixel;

the first sub-pixel of one pixel being adjacent to a first sub-pixel of an adjacent pixel in the column direction;

the second sub-pixel of the same one pixel being adjacent to a first sub-pixel of an adjacent pixel in the row direction;

the third sub-pixel of the same one pixel being adjacent to the first sub-pixel of the adjacent pixel in the row direction, the second and third sub-pixels having an alternating arrangement in the column direction;

the third sub-pixel of the same one pixel and the first sub-pixel of the adjacent pixel configured to share a first power line;

a first data line configured to transfer data signals to the first sub-pixel of the adjacent pixel and located between the first power line and an edge of the first sub-pixel of the adjacent pixel; and a third data line configured to transfer data signals to the third sub-pixel of the same one pixel and located between the first power line and an edge of the third sub-pixel of the same one pixel.

2. The display panel of claim 1, wherein the first power line positioned between the first and third data lines is configured to minimize interference due to parasitic capacitance between the first and third data lines.

3. The display panel of claim 2 further comprising: a second data line located between an edge of the first sub-pixel of the same one pixel and an another edge of the third sub-pixels of the same one pixel;

wherein the second data line configured to transfer data signals to the second sub-pixel of the same one pixel.

4. The display panel of claim 3 further comprising: a second power line positioned between the second power line and an edge of the first sub-pixel of the same one pixel;

wherein the second power line configured to supply power to the second sub-pixel of the same one pixel.

5. The display panel of claim 4 further comprising: a second electrode within the second sub-pixel of the same one pixel positioned in a region between the second data line and the third data line without overlapping with the second data line and the third data line to minimize interference due to overlap capacitance between a data line and an electrode of an adjacent pixel.

6. The display panel of claim 5 further comprising: a third electrode within the third sub-pixel of the same one pixel positioned in a region between the second data line and the third data line without overlapping with the second data line and the third data line to minimize interference due to overlap capacitance between a data line and an electrode of an adjacent pixel.

7. The display panel of claim 4, further comprising a third driving thin film transistor of the second sub-pixel of the same one pixel, wherein the third driving thin film transistor is connected to the second power line.

8. The display panel of claim 1, wherein, the first sub-pixel is blue sub-pixel, the second sub-pixel is green sub-pixel, and the third sub-pixel is red sub-pixel.

9. The display panel of claim 1, wherein, the display panel is a high definition organic light emitting display panel.

10. The display panel of claim 1, wherein overlap capacitance between a data line and an electrode of an adjacent pixel, and density of pixels is maintained or increased compared to when the data line is overlapped with the electrode of the adjacent pixel.

11. The display panel of claim 1, further comprising a plurality of sensing thin film transistors in the array of pixels connected to a plurality of sensing lines, configured to provide sensing voltages to be detected.

12. The display panel of claim 1, further comprising a first driving thin film transistor of the first sub-pixel of the one pixel and a second driving thin film transistor of the first sub-pixel of the adjacent pixel, wherein the first driving thin film transistor and the second driving thin film transistor are connected to the first power line.

* * * * *